US011253074B2

(12) United States Patent
Gallina

(10) Patent No.: US 11,253,074 B2
(45) Date of Patent: Feb. 22, 2022

(54) FOLDING CHAIR HAVING A SEAT PORTION, FIRST FRAME AND SECOND FRAME

(71) Applicant: GABER SRL, Frazione Caselle (IT)

(72) Inventor: Luigino Gallina, Frazione Caselle (IT)

(73) Assignee: GABER SRL, Altivole (IT)

( * ) Notice: Subject to any disclaimer, the term of this patent is extended or adjusted under 35 U.S.C. 154(b) by 0 days.

(21) Appl. No.: 17/005,618

(22) Filed: Aug. 28, 2020

(65) Prior Publication Data

US 2021/0059415 A1 Mar. 4, 2021

(30) Foreign Application Priority Data

Aug. 30, 2019 (IT) ..... 102019000015258

(51) Int. Cl.
*A47C 3/04* (2006.01)
*A47C 4/08* (2006.01)
*A47C 4/14* (2006.01)

(52) U.S. Cl.
CPC . *A47C 4/14* (2013.01); *A47C 3/04* (2013.01)

(58) Field of Classification Search
CPC .. A47C 4/14; A47C 3/04; A47C 3/045; A47C 4/025; A47C 4/08
USPC ..... 297/23–26, 55–57
See application file for complete search history.

(56) References Cited

U.S. PATENT DOCUMENTS

| | | | | |
|---|---|---|---|---|
| 5,096,259 | A * | 3/1992 | Stanfield | A47C 4/10 297/239 |
| 5,328,232 | A * | 7/1994 | Whitehead | A47C 4/14 297/50 |
| 5,738,408 | A * | 4/1998 | Wu | A47C 3/04 297/239 |
| 2004/0004371 | A1* | 1/2004 | Noor | A47C 4/10 297/58 |
| 2010/0078971 | A1 | 4/2010 | Huang | |

OTHER PUBLICATIONS

Italian Search Report and Written Opinion dated Mar. 9, 2020 issued in IT 201900015258, with partial translation.

* cited by examiner

*Primary Examiner* — Robert Canfield
(74) *Attorney, Agent, or Firm* — Scully, Scott, Murphy & Presser, P.C.

(57) ABSTRACT

A folding chair that includes a seat portion, a first frame, the first frame including a back and two first parallel legs, the two first legs being monolithic with the back, the first frame being hinged to the seat portion at the two first legs on two opposite sides of the perimetric edge of the seat portion, and a second frame, the second frame including two second parallel and mutually integral legs, the second frame being pivoted to the first frame at two crossing regions of one of the second legs with a respective one of the first legs.

10 Claims, 4 Drawing Sheets

FOLDING CHAIR HAVING A SEAT PORTION, FIRST FRAME AND SECOND FRAME

The present invention relates to a chair of the folding type.

Folding chairs are currently widespread and used in various environments, such as for example the domestic environment, in the field of garden items or of beach items.

A chair usually has:

a seat portion, which is substantially horizontal, a back, which is substantially vertical and substantially perpendicular to the seat portion, four supporting legs, two rear legs and two front legs.

The expression "folding chair" is meant to refer to a chair that can be closed by moving the back toward the seat portion and/or by arranging one so as to face the other.

Because of their simplicity in manufacture and use, folding chairs have become commercially established in which there are:

a seat portion, a first frame, which comprises the back and two parallel legs, monolithically and/or integral with the back, a second frame, which comprises the other two legs, which are parallel.

The first frame is usually hinged to the seat portion at each of its legs, while the second frame is usually hinged on the seat portion or on the first frame at each leg thereof.

In this manner it is possible to close the chair by rotating the seat portion with respect to the first and/or second frame and the two frames by rotating one with respect to the other.

These known methods have some drawbacks.

In order to be able to provide the frames, the seat portion, and the respective hinges, a considerable number of components is usually used and this causes constructive complexity and expenditure of time.

Furthermore, in order to be able to assemble the chair, components made of metallic material, such as for example pivots and screws, are often used and in the long term may deteriorate and generate rust if exposed to atmospheric agents.

Likewise, materials such as metal and wood, which can deteriorate over time, especially if subjected to atmospheric agents, are often used also for the frames and the seat portion.

Moreover, once they are closed, folding chairs are stacked, resting them on each other, in order to reduce their general space occupation.

Often, however, due to the smooth surfaces of mutual interaction between two successive chairs, one chair can slide on the other, moving from the stack and/or making it collapse.

This problem is particularly felt during the transport of a stack of folding chairs.

The aim of the present invention is to provide a folding chair that is capable of improving the background art in one or more of the aspects indicated above.

Within this aim, an object of the invention is to provide a folding chair with a smaller number of components than similar chairs of the known type and which can be assembled more easily and rapidly with respect to that ones.

Another object of the invention is to provide a folding chair with materials that deteriorate less than the materials used in similar chairs of the known type if exposed to atmospheric agents and therefore lasts longer than similar chairs of the known type.

A further object of the invention is to provide a folding chair that can be stacked easily and stably on a similar one.

A still further object of the present invention is to overcome the drawbacks of the background art in a manner that is alternative to any existing solutions.

Not least object of the invention is to provide a folding chair that is highly reliable, relatively easy to provide and at competitive costs.

This aim, as well as these and other objects which will become better apparent hereinafter, are achieved by a folding chair, comprising:

a seat portion, a first frame, said first frame comprising a back and two first parallel legs, said two first legs being monolithic with said back, said first frame being hinged to said seat portion at said two first legs on two opposite sides of the perimetric edge of said seat portion, a second frame, said second frame comprising two second parallel and mutually integral legs, said second frame being pivoted to said first frame at two crossing regions of one of said second legs with a respective one of said first legs, said chair being characterized in that it is entirely made of plastic-based material.

Further characteristics and advantages of the invention will become better apparent from the description of a preferred but not exclusive embodiment of the folding chair according to the invention, illustrated by way of non-limiting example in the accompanying drawings, wherein:

FIGS. 1*a* and 1*b* are two views of a folding chair according to the invention;

Figure 1B:
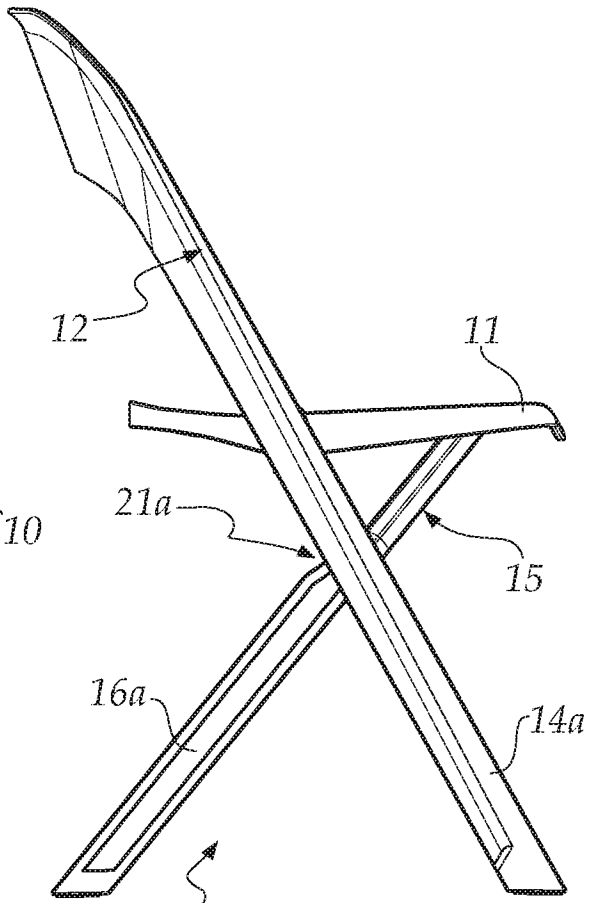
Figure 1A:
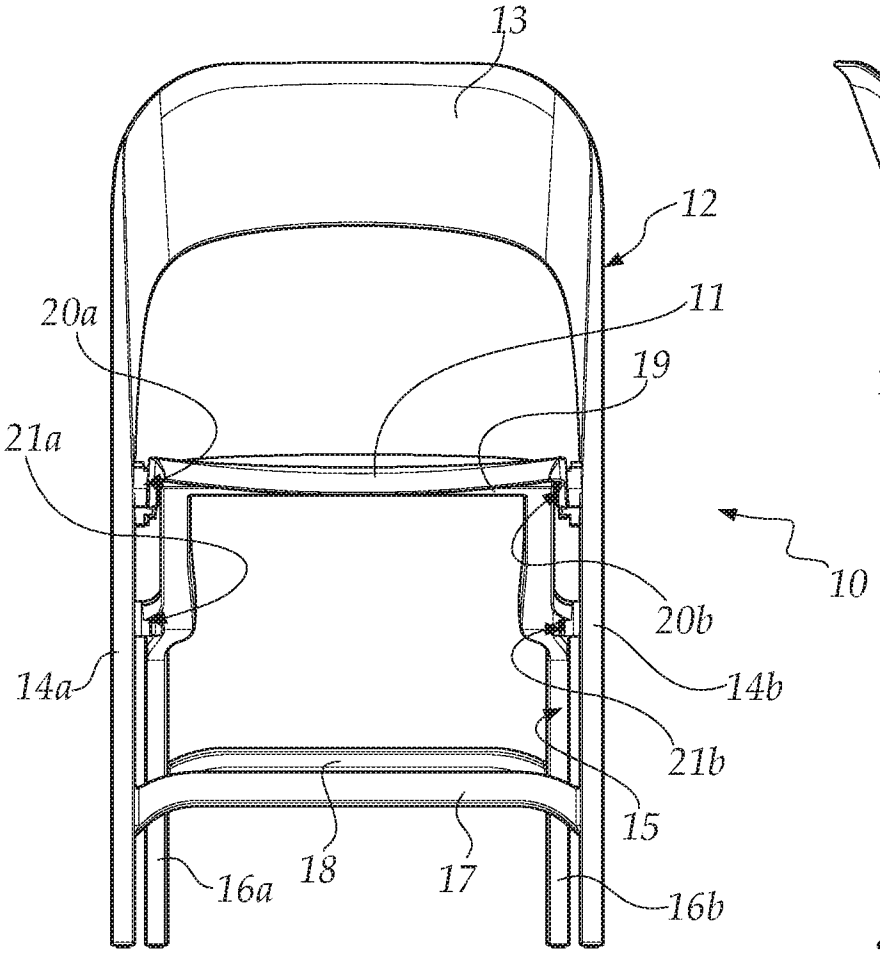
Figure 3:
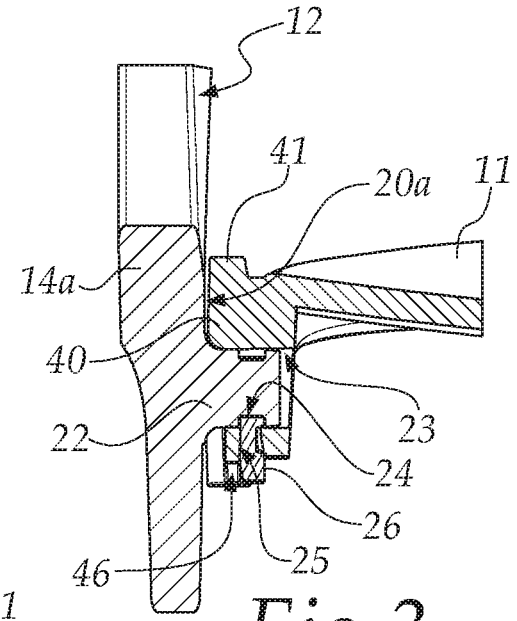
FIG. 3 is a second sectional detail view of the chair of FIGS. 1*a* and 1*b;*
Figure 3A:
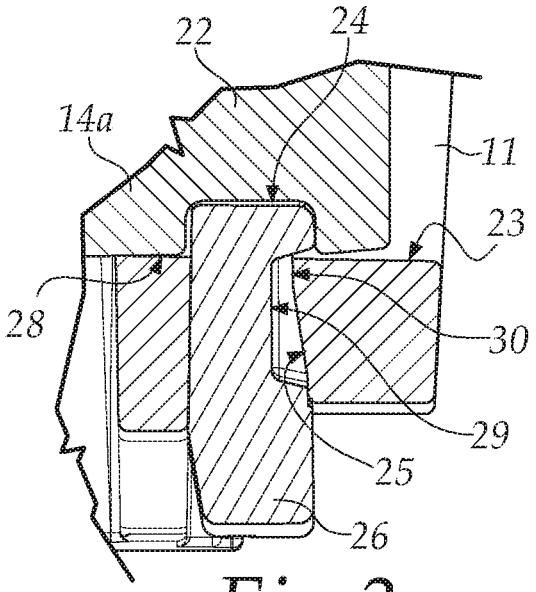
Figure 4:
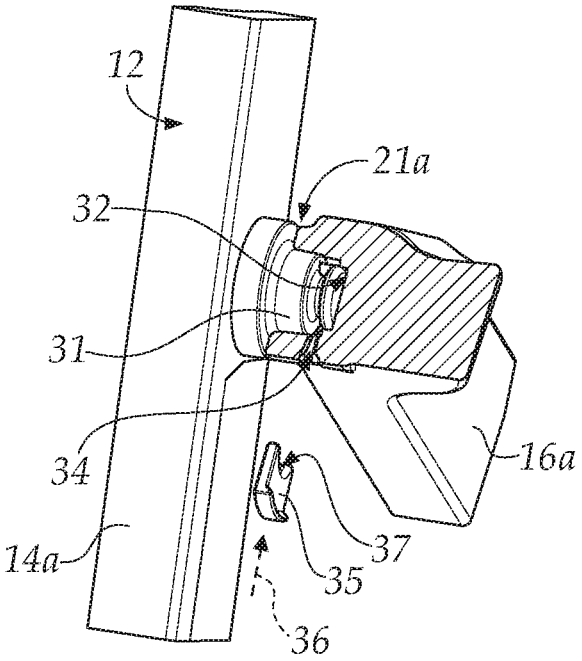

FIG. 3*a* is an enlarged-scale view of a detail of FIG. 3;

FIG. 4 is a third exploded and partially sectional detail view of the chair of FIGS. 1*a* and 1*b;*

Figure 5:
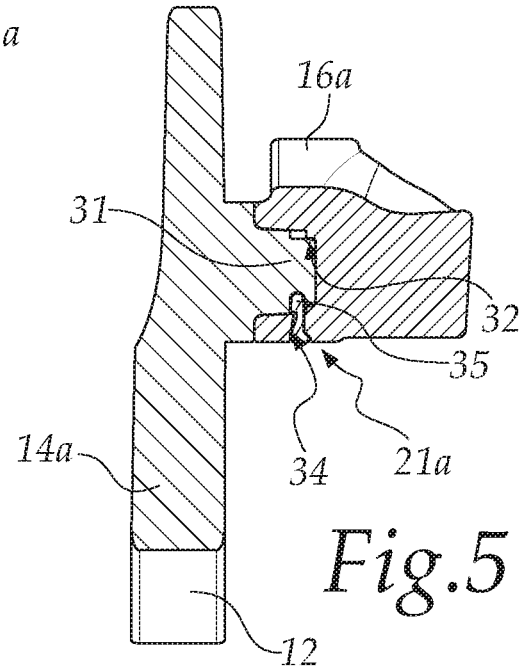

FIG. 5 is a fourth sectional detail view of the chair of FIGS. 1*a* and 1*b;*

Figure 5A:
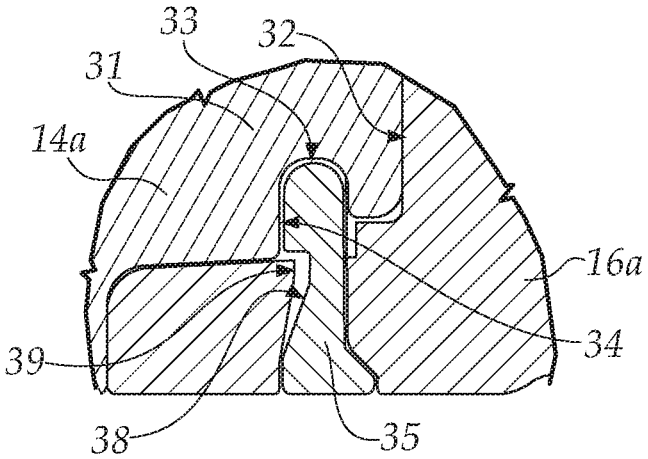
Figure 6:
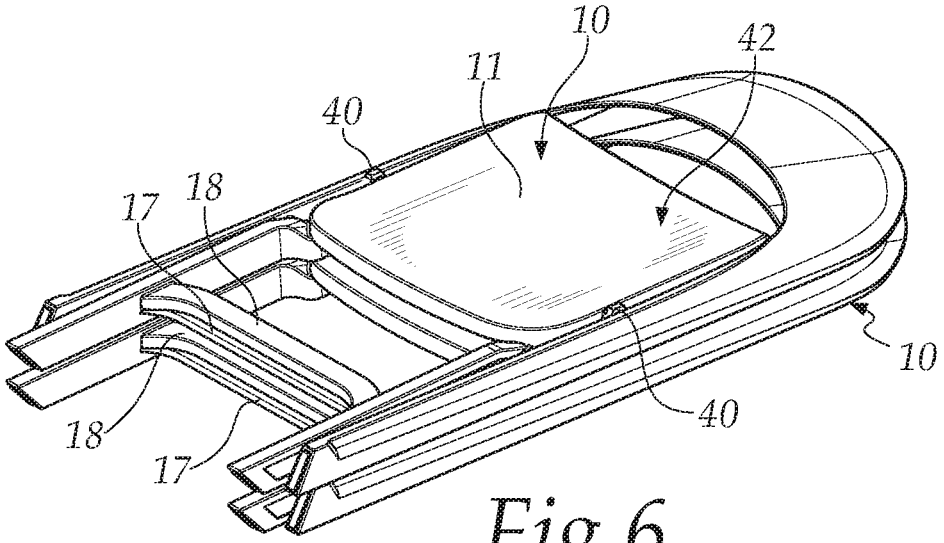
Figure 7:
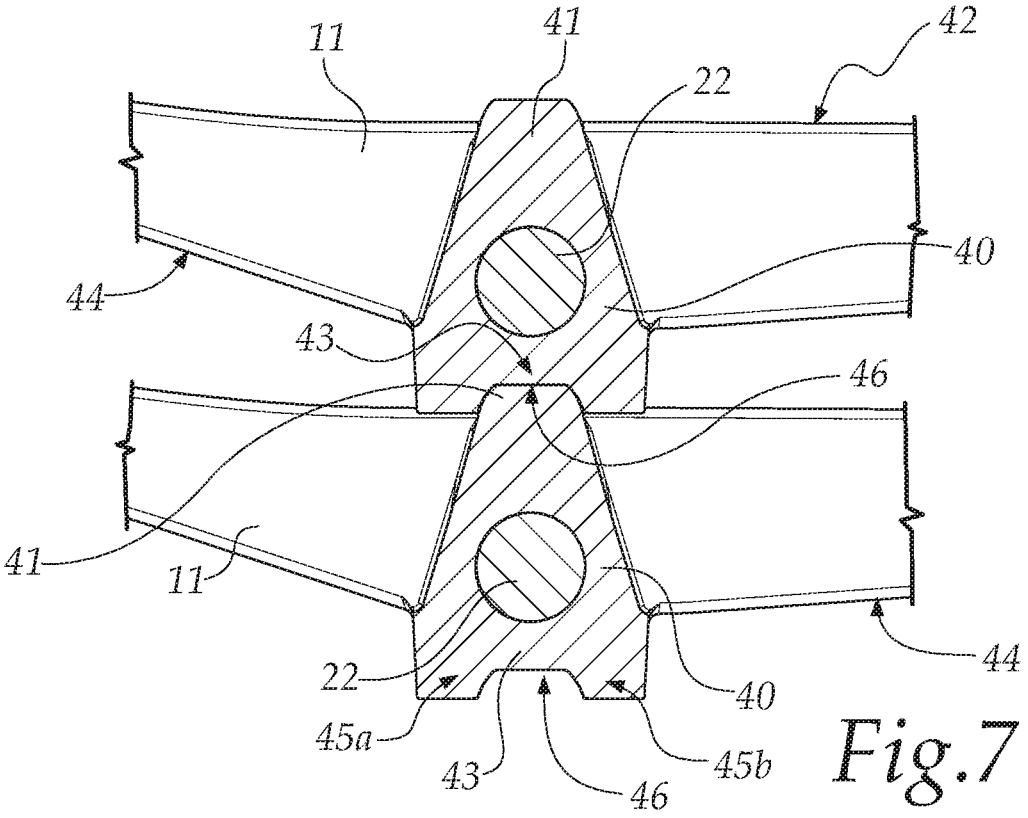

FIG. 5*a* is an enlarged-scale view of a detail of FIG. 5;

FIG. 6 is a view of a chair according to the invention in a possible configuration for use thereof;

FIG. 7 is a sectional detail view of what is shown in FIG. 6.

With reference to the figures, a folding chair according to the invention is designated generally by the reference numeral 10.

The folding chair 10 comprises:

a seat portion 11, a first frame 12, which in turn comprises a back 13 and two first legs 14*a* and 14*b*, which are parallel and monolithic with the back 13, a second frame 15, which in turn comprises two second legs 16*a*, 16*b*, which are parallel and mutually integral.

The first frame 12 comprises a first bridge element 17 between the two first legs 14*a*, 14*b*, which is perpendicular to both and monolithic with them and is arranged proximate to the end of the first legs 14*a*, 14*b* to be rested on the ground in the configuration for use.

The expression "configuration for use", in the present description, is meant to refer to the open chair 10, as shown in FIGS. 1*a* and 1*b*.

Likewise, the second frame 15 comprises a second bridge element between the two second legs 16*a* and 16*b*, which is perpendicular to both legs and monolithic with them and is arranged proximate to the end of the second legs 16*a* and 16*b*, to be rested on the ground in the configuration for use.

Furthermore, the second frame 15 comprises a third bridge element 19 between the two second legs 16*a* and 16*b*, which is perpendicular to both and monolithic with them and arranged at the end of the second legs 16*a* and 16*b* in contact with the seat portion 11 in the configuration for use.

The third bridge element 19 is a support for the seat portion 11, in the configuration for use, and gives strength to the chair 10.

The seat portion 11 is substantially flat and substantially horizontal in the configuration for use.

The seat portion 11 is contained between the two first legs 14*a* and 14*b* and has an extension between them that is substantially equal to their distance.

The first frame 12 is hinged to the seat portion 11 at its two first legs 14*a* and 14*b*, on two opposite sides 20*a* and 20*b* of the perimetric edge of the seat portion 11.

The second frame 15 is hinged to the first frame 12 at two regions 21*a* and 21*b*, for the crossing of one of the second legs 16*a*, 16*b* with a respective one of the first legs 14*a*, 14*b*.

The regions 21*a*, 21*b* for the pivoting of the first frame 12 to the second frame 15 are, in the configuration for use, below the seat portion 11.

In this manner it is possible to rotate the seat portion 1*l* with respect to the first frame 12 (and vice versa) and it is possible to rotate the first frame 12 with respect to the second frame 15 (and vice versa).

One of the particularities of the invention resides in that the chair 10 is entirely made of plastic-based material.

This characteristic allows it to be resistant to antibacterial and antimicrobial treatments of disinfection chambers, for example in hospitals and/or healthcare facilities.

In particular, the chair 10 is made of a composite constituted by polypropylene and reinforcement fibers.

The reinforcement fibers are, for example, glass fibers.

The percentage in mass of reinforcement fibers is comprised between 19% and 22%.

Preferably, the reinforcement fibers are equal to 20% of the composite material used.

The ends of the legs 14*a*, 14*b*, 16*a*, 16*b* that are in contact with the ground in the configuration for use may have feet made of rigid polyurethane (not shown in the figures).

Since it is entirely made of plastic-based material, the chair 10 deteriorates less than similar chairs of the known type if exposed to atmospheric agents and therefore lasts longer than that ones.

Another of the particularities of the invention resides in the fixing systems:

between the first frame 12 and the seat portion 11, between the first frame 12 and the second frame 15.

In particular, a first pivot 22 extends from each first leg 14*a*, 14*b* and has a substantially cylindrical space occupation in the direction of a corresponding side 20*a*, 20*b* of the perimetric edge of the seat portion 11.

Figure 2:
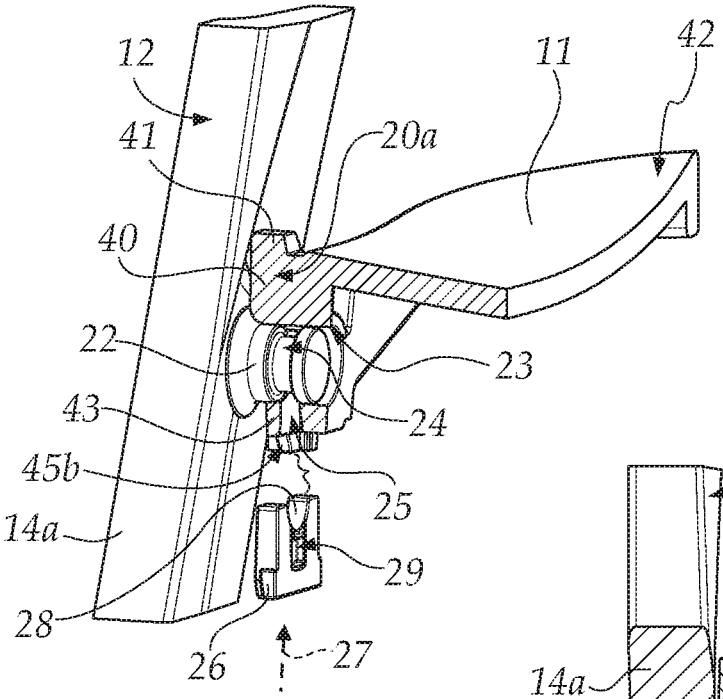
FIG. 2 is a first exploded and partially sectional detail view of the chair of FIGS. 1*a* and 1*b;*

FIGS. 2 to 3*a* show only the association between the first leg 14*a* and the seat portion 11; however, the association between the other first leg 14*b* and the seat portion 11 is similar.

The first pivot 22 is inserted in a corresponding first seat 23 on the side 20*a*, 20*b* of the perimetric edge of the seat portion 11.

The dimensions of the first seat 23 are such as to allow an easy rotation of the first pivot 22 inside it.

This first pivot 22 has a substantially cylindrical body with a substantially central portion 24 that has a reduced cross-section.

The substantially central portion 24 is arranged as a first through opening 25 on the side wall of the first seat 23 that is perpendicular to the axis of extension of the first pivot 22.

A substantially wedge-shaped first locking element 26 is inserted in the first opening 25 in the direction of the arrow 27.

In particular, the first locking element 26 has an end 28 that is C-shaped and partially surrounds the substantially central portion 24 of the first pivot 22.

The first locking element 26 is provided with a recess 29 in which a corresponding portion 30 of the side wall of the first opening 25 of the first seat 23, which protrudes toward the inside of the first opening 25, is inserted.

At the portion 30 of the side wall of the first opening 25, said first opening 25 has a cross-section that is comparable with the cross-section of the first locking element 26 at its recess 29, as is evident in FIG. 3*a*.

An interference is thus provided between the first opening 25 and the first locking element 26, which prevents:

the first pivot 22 from exiting from the first seat 23, the first frame 12 from disconnecting from the seat portion 11.

The first locking element 26 is inserted in the first opening 25, forcing its entry, for example with a hammer blow, after inserting the first pivot 22 in the corresponding first seat 23.

Once it has been engaged, a stable association is provided between the first frame 12 and the seat portion 11.

Likewise, a second pivot 31 extends from each first leg 14*a*, 14*b* and has a substantially cylindrical space occupation in the direction of a corresponding second leg 16*a*, 16*b*.

FIGS. 4 to 5*a* show only the association between the first leg 14*a* and the second leg 16*a*; however, the association between the other first leg 14*b* and the other second leg 16*b* is similar.

The second pivot 31 is inserted in a corresponding second seat 32 on the corresponding second leg 16*a*, 16*b*.

The dimensions of the second seat 32 are such as to allow an easy rotation of the second pivot 31 inside it.

The second pivot 31 has a substantially cylindrical body with a substantially central portion 33 that has a reduced cross-section.

The substantially central portion 33 is arranged at a second through opening 34 on the side wall of the second seat 32, which is perpendicular to the axis of extension of the second pivot 31.

A second substantially wedge-shaped locking element 35 is inserted in the second opening 34 in the direction of the arrow 36.

In particular, the second locking element 35 has a C-shaped end 37 which partially surrounds the substantially central portion 33 of the second pivot 31.

The second locking element 35 is provided with a recess 38 in which a corresponding portion 39 of the side wall of the second opening 34 of the second seat 32 is inserted.

This portion 39 protrudes toward the inside of said second opening 34.

At the portion 39 of the side wall of the second opening 34, said second opening 34 has a cross-section that is comparable with the cross-section of the second locking element 35 at its recess 38, as is evident in FIG. 5*a*.

An interference is thus provided between the second opening 34 and the second locking element 35 and prevents:

the second pivot 31 from exiting from the second seat 32, the first frame 12 from disconnecting from the second frame 15.

The second locking element 35 is inserted in the second opening 34, forcing its entry, for example with a hammer blow, after inserting the second pivot 31 in the corresponding second seat 32.

Once it has been engaged, a stable association is provided between the first frame 12 and the second frame 15.

The second locking element 35 has such shape and dimensions as to not protrude from the second opening 34 once it has it been inserted therein.

It should be noted that such an association between the frames 12, 15 and the seat portion 11 allows a quicker and easier assembly than that of similar chairs of the known type, and with a smaller number of parts.

With reference to FIGS. 6 and 7, another particularity of the invention resides in the possibility to stack easily and stably a chair 10, once closed, on a similar one.

The seat portion 11 has, at the regions of interaction with the first legs 14*a*, 14*b*, two stacking elements 40.

Each stacking element 40 has:

a first part 41, which protrudes with respect to the upper surface 42, in the configuration for use, of the seat portion 11, a second part 43, which is opposite the preceding one with respect to the seating plane, which protrudes with respect to the lower surface 44, in the configuration for use, of the seat portion 11.

The stacking element 40 has a substantially V-shaped profile, with the first part 41 that corresponds to the vertex of the V-shape and the second part 43 that corresponds to the portions of the wings of the V-shape.

In particular, the second part 43 comprises two wings 45*a* and 45*b*, between which there is a recess 46 for the insertion of a first part 41 of a corresponding stacking element 40 of another chair 10.

In this manner it is possible to stack multiple chairs 10 on each other, easily and stably, i.e., without the risk of a chair 10 slipping on another.

In practice it has been found that the invention achieves the intended aim and objects, providing a folding chair with a smaller number of components than similar chairs of the known type and which can be assembled more easily and quickly than that ones.

The invention provides a folding chair with materials that deteriorate less than the materials used in similar chairs of the known type, if exposed to atmospheric agents, and therefore lasts longer than that ones.

Finally, the invention provides a folding chair that can be stacked easily and stably on a similar one.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102019000015258 from which this application claims priority are incorporated herein by reference.

The invention claimed is:

1. A folding chair, comprising:

a seat portion, a first frame, said first frame comprising a back and two first parallel legs, said two first legs being monolithic with said back, said first frame being hinged to said seat portion at said two first legs on two opposite sides of a perimetric edge of said seat portion, wherein a first pivot extends from each one of said first legs in a direction of a corresponding one of said sides of the perimetric edge of said seat portion, said first pivot being inserted in a corresponding first seat on a corresponding one of said sides of the perimetric edge of said seat portion, and wherein said first pivot has a substantially cylindrical body with a substantially central portion having a reduced cross-section, said substantially central portion being located at a first through opening, said first opening being on a side wall of said first seat, said first opening being perpendicular to an axis of extension of said first pivot, a first locking element being inserted in said first opening, a second frame, said second frame comprising two second parallel and mutually integral legs, said second frame being pivoted to said first frame at two crossing regions of one of said second legs with a respective one of said first legs, wherein said chair is entirely made of plastic-based material.

2. The chair according to claim 1, wherein said plastic-based material is a composite constituted by polypropylene and reinforcement fibers.

3. The chair according to claim 1, wherein said first locking element has a C-shaped end which partially surrounds said substantially central portion of said first pivot, said first locking element having a recess in which a corresponding portion of the side wall of said first opening of said first seat is inserted, said portion of the side wall of said first opening protruding toward an inside of said first opening.

4. The chair according to claim 3, wherein a second pivot extends from each one of said first legs in the direction of a corresponding one of said second legs, said second pivot being inserted in a corresponding second seat on the corresponding one of said second legs.

5. The chair according to claim 4, wherein said second pivot has a substantially cylindrical body with a substantially central portion having a reduced cross-section, said substantially central portion being arranged at a second through opening, said second opening being on the side wall of said second seat, said second opening being perpendicular to an axis of extension of said second pivot, a second locking element being inserted in said second opening.

6. The chair according to claim 5, wherein said second locking element has a C-shaped end which partially surrounds said substantially central portion of said second pivot, said second locking element being provided with a recess in which a corresponding portion of the side wall of said second opening of said second seat is inserted, said portion of the side wall of said second opening protruding toward the inside of said second opening.

7. The chair according to claim 1, wherein said seat portion has two stacking elements at regions of interaction with said first legs, each one of said stacking elements having:

a first part, which protrudes with respect to an upper surface, in a configuration for use, of said seat portion, a second part, arranged opposite said first part with respect to the seating plane, said second part protruding with respect to a lower surface, in the configuration for use, of said seat portion.

8. The chair according to claim 7, wherein each one of said stacking elements has a substantially V-shaped profile with said first part that corresponds to a vertex of said V-shape and said second part that corresponds to portions of the wings of said V-shape, said second part comprising two wings between which a recess is defined.

9. A folding chair, comprising:

a seat portion, a first frame, said first frame comprising a back and two first parallel legs, said two first legs being monolithic with said back, said first frame being hinged to said seat portion at said two first legs on two opposite sides of a perimetric edge of said seat portion, wherein said seat portion has two stacking elements at regions of interaction with said first legs, each one of said stacking elements having:

a first part, which protrudes with respect to an upper surface, in a configuration for use, of said seat portion, a second part, arranged opposite said first part with respect to the seating plane, said second part protruding with respect to a lower surface, in the configuration for use, of said seat portion, a second frame, said second frame comprising two second parallel and mutually integral legs, said second frame being pivoted to said first frame at two crossing regions of one of said second legs with a respective one of said first legs, wherein said chair is entirely made of plastic-based material.

10. The chair according to claim 9, wherein each one of said stacking elements has a substantially V-shaped profile with said first part that corresponds to a vertex of said V-shape and said second part that corresponds to portions of the wings of said V-shape, said second part comprising two wings between which a recess is defined.

* * * * *